US007978993B2

(12) United States Patent
Nagatsuka

(10) Patent No.: US 7,978,993 B2
(45) Date of Patent: Jul. 12, 2011

(54) IMAGE FORMING APPARATUS, COMPUTER PROGRAM PRODUCT FOR FORMING IMAGE, AND IMAGE FORMING METHOD

(75) Inventor: Shingo Nagatsuka, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 77 days.

(21) Appl. No.: 12/458,252

(22) Filed: Jul. 7, 2009

(65) Prior Publication Data

US 2010/0008681 A1 Jan. 14, 2010

(30) Foreign Application Priority Data

Jul. 8, 2008 (JP) ..... 2008-178074
Jun. 26, 2009 (JP) ..... 2009-152881

(51) Int. Cl.
*G03G 15/00* (2006.01)

(52) U.S. Cl. ..... 399/49; 399/44

(58) Field of Classification Search ..... 399/38, 399/43, 44, 49, 72
See application file for complete search history.

(56) References Cited

U.S. PATENT DOCUMENTS 6,115,561 A * 9/2000 Fukushima ..... 399/49
6,181,888 B1 * 1/2001 Scheuer et al. ..... 399/49
7,113,712 B2 * 9/2006 Gomi ..... 399/49 X
7,538,918 B2 * 5/2009 Oki ..... 399/38 X
7,587,149 B2 * 9/2009 Suzuki et al. ..... 399/49
2008/0279599 A1 11/2008 Nagatsuka

FOREIGN PATENT DOCUMENTS

JP 2002-116586 4/2002
JP 3385495 1/2003
JP 3924375 3/2007

OTHER PUBLICATIONS

Abstract of JP 11-258893 published on Sep. 24, 1999.
Abstract of JP 08-095460 published on Apr. 12, 1996.

* cited by examiner

*Primary Examiner* — Sandra L Brase
(74) *Attorney, Agent, or Firm* — Harness, Dickey & Pierce, P.L.C.

(57) ABSTRACT

A first calculating unit calculates an allocation time required for forming a patch pattern. A second calculating unit calculates a maximum patch-pattern length of the patch pattern that can be formed within the allocation time based on the number of patch patterns that can be formed within the allocation time. A setting unit calculates a difference between an environmental temperature around the image forming apparatus and an environmental temperature at which the image forming condition stored in the storing unit is set, and newly sets an image forming condition for the patch patterns based on a result of comparing the difference with a predetermined threshold.

17 Claims, 10 Drawing Sheets

FIG. 6
| TARGET FIXING TEMPERATURE [°C]-<br>FIXING MEASUREMENT TEMPERATURE [°C] | FIXING WUP TIME<br>[SEC] |
|---|---|
| ⊿T1 | Twup1 |
| ⊿T2 | Twup2 |
| ⊿T3 | Twup3 |
| : | : |
| ⊿Tn-1 | Twupn-1 |
| ⊿Tn | Twupn |
FIG. 7A
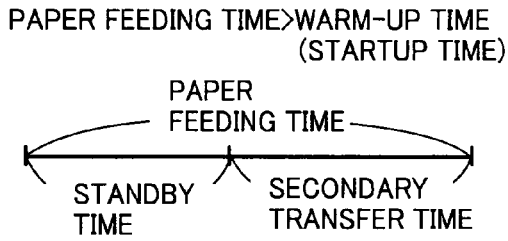
FIG. 7B
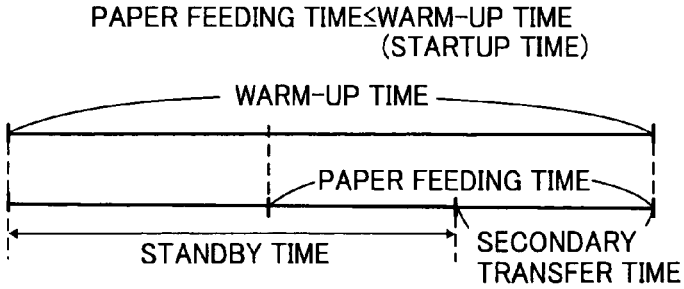

IMAGE FORMING APPARATUS, COMPUTER PROGRAM PRODUCT FOR FORMING IMAGE, AND IMAGE FORMING METHOD

CROSS-REFERENCE TO RELATED APPLICATIONS

The present application claims priority to and incorporates by reference the entire contents of Japanese Patent Application No. 2008-178074 filed in Japan on Jul. 8, 2008 and Japanese Patent Application No. 2009-152881 filed on Jun. 26, 2009.

BACKGROUND OF THE INVENTION

1. Field of the Invention

The present invention relates to a technology for forming an image using electrophotography.

2. Description of the Related Art

Image density formed by an image forming apparatus typically varies affected by various influences. To cope with this problem, a density adjustment technology for stabilizing the image density is widely known, in which a patch for measuring density (hereinafter, "patch pattern") is formed on an image carrier, image density of the patch pattern is measured to obtain a developing characteristic, and image-forming conditions, such as a developing bias or an amount of exposure, that affect the image density are adjusted according to the developing characteristic.

When the density is adjusted, there is a problem in that a downtime occurs from when the patch pattern is formed to when the image density is detected, during which a user cannot make prints. Three types of conventionally known technologies for coping with the problem are disclosed in, for example, Japanese Patent Application Laid-open No. H08-95460, Japanese Patent No. 3924375, and Japanese Patent Application Laid-open No. 2002-116586. In the technology disclosed in Japanese Patent Application Laid-open No. H08-95460, density adjustment is performed during a warm-up of a fixing unit, i.e., a period of time until the fixing unit is heated to a predetermined temperature. In the technology disclosed in Japanese Patent No. 3924375, an aging operation that can be implemented within a warm-up of a fixing unit until when the fixing unit is heated to a predetermined temperature is performed. In the technology disclosed in Japanese Patent Application Laid-open No. 2002-116586, density adjustment is performed by forming patch patterns by changing a laser power, obtaining density information about the patch patterns, and selecting a method of density adjustment that can be implemented within a warm-up of a fixing unit, i.e., a period of time until the fixing unit is heated to a predetermined temperature.

However, in the technology disclosed in Japanese Patent Application Laid-open No. H08-95460, when the warm-up time for fixing is short, a downtime occurs caused by the density adjustment. In the technology disclosed in Japanese Patent No. 3924375, the downtime caused by the density adjustment does not occur, but it is impossible to adjust a factor for density control other than an amount of charge of a developer. In the technology disclosed in Japanese Patent Application Laid-open No. 2002-116586, the downtime caused by the density adjustment does not occur, and the factor for density control other than the amount of charge of the developer can be adjusted; however, it is difficult to obtain an accurate developing characteristic within a limited time because the patch-pattern forming condition is selected from among several alternatives prepared in advance.

The reason for difficulty in obtaining the accurate developing characteristic within a predetermined time when the patch-pattern forming condition is selected from among the alternatives prepared in advance is described below. The only way to form the patch pattern within a limited time is to reduce the number of patch patterns. The developing characteristic (relation between laser power and density) may possibly be non-linear characteristics, and therefore, the patch pattern near the target density needs to be formed for obtaining an accurate developing characteristic. However, in the technology disclosed in Japanese Patent Application Laid-open No. 2002-116586, because the number of laser power values to be ready is merely considered in terms of determining the patch-pattern forming condition, it is difficult to form the patch pattern near the target density even when fixed patch-pattern forming conditions prepared in advance are used.

SUMMARY OF THE INVENTION

It is an object of the present invention to at least partially solve the problems in the conventional technology.

According to one aspect of the present invention, there is provided an image forming apparatus that forms a plurality of patch patterns on an image carrier, measures densities of the patch patterns formed on the image carrier, and updates an image forming condition for the patch patterns stored in a storing unit based on a result of measuring the density of the patch patterns. The image forming apparatus includes a first calculating unit that calculates an allocation time required for forming the patch patterns; a second calculating unit that calculates a maximum patch-pattern length of the patch patterns that can be formed within the allocation time based on a number of patch patterns that can be formed within the allocation time; and a first setting unit that calculates a difference between a first environmental temperature around the image forming apparatus and a second environmental temperature at which the image forming condition stored in the storing unit is set, compares the difference with a predetermined threshold, and newly sets an image forming condition for the patch patterns based on a result of comparing the difference and the threshold. When the difference is smaller than the threshold, the first setting unit newly sets a region near a last updated image forming condition that is stored in the storing unit as an image forming condition for the patch patterns to be formed in the maximum patch-pattern length. On the other hand, when the difference is larger than the threshold, the first setting unit newly sets an entire region of the image forming condition that can be set by the image forming apparatus as an image forming condition for the patch patterns to be formed in the maximum patch-pattern length.

Furthermore, according to another aspect of the present invention, there is provided a computer program product including a computer-usable medium having computer-readable program codes embodied in the medium for forming an image in an image forming apparatus that forms a plurality of patch patterns on an image carrier, measures densities of the patch patterns formed on the image carrier, and updates an image forming condition for the patch patterns stored in a storing unit based on a result of measuring the density of the patch patterns. The program codes when executed cause a computer to execute first calculating including calculating an allocation time required for forming the patch patterns; second calculating including calculating a maximum patch-pattern length of the patch patterns that can be formed within the allocation time based on a number of patch patterns that can be formed within the allocation time; and first setting including calculating a difference between a first environmental temperature around the image forming apparatus and a second environmental temperature at which the image forming condition stored in the storing unit is set, comparing the difference with a predetermined threshold, and setting newly an image forming condition for the patch patterns based on a result of comparing the difference and the threshold. When the difference is smaller than the threshold, the first setting includes setting a region near a last updated image forming condition that is stored in the storing unit as an image forming condition for the patch patterns to be formed in the maximum patch-pattern length. When the difference is larger than the threshold, the first setting includes setting an entire region of the image forming condition that can be set by the image forming apparatus as an image forming condition for the patch patterns to be formed in the maximum patch-pattern length.

Moreover, according to still another aspect of the present invention, there is provided a method of forming an image in an image forming apparatus that forms a plurality of patch patterns on an image carrier, measures densities of the patch patterns formed on the image carrier, and updates an image forming condition for the patch patterns stored in a storing unit based on a result of measuring the density of the patch patterns. The method includes first calculating including calculating an allocation time required for forming the patch patterns; second calculating including calculating a maximum patch-pattern length of the patch patterns that can be formed within the allocation time based on a number of patch patterns that can be formed within the allocation time; and setting including calculating a difference between a first environmental temperature around the image forming apparatus and a second environmental temperature at which the image forming condition stored in the storing unit is set, comparing the difference with a predetermined threshold, and setting newly an image forming condition for the patch patterns based on a result of comparing the difference and the threshold. When the difference is smaller than the threshold, the setting includes setting a region near a last updated image forming condition that is stored in the storing unit as an image forming condition for the patch patterns to be formed in the maximum patch-pattern length. When the difference is larger than the threshold, the setting includes setting an entire region of the image forming condition that can be set by the image forming apparatus as an image forming condition for the patch patterns to be formed in the maximum patch-pattern length.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a table of values of a fixing warm-up time;

FIGS. 7A and 7B are schematic diagrams for explaining the relation between a paper feeding time and a fixing warm-up time;

DETAILED DESCRIPTION OF THE PREFERRED EMBODIMENTS

Exemplary embodiments of the present invention are described in detail below with reference to the accompanying drawings.

The basic configuration of an image forming apparatus according to an embodiment of the present invention is described.

Figure 1:
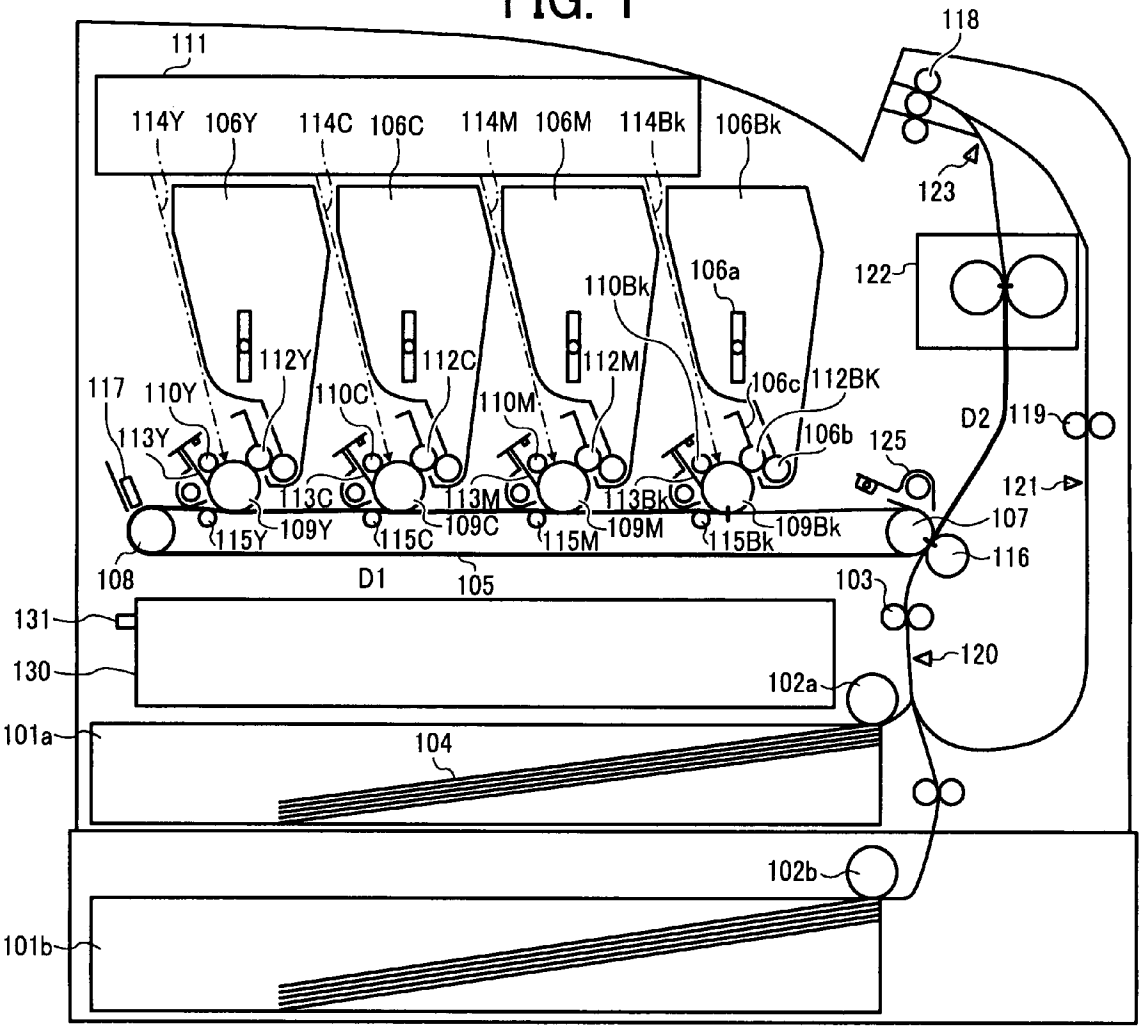
FIG. 1 is a schematic diagram of an internal structure of an image forming apparatus according to an embodiment of the present invention.

FIG. 1 is a schematic diagram of an image forming apparatus according to a first embodiment of the present invention. The image forming apparatus shown in FIG. 1 includes a plurality of process cartridges 106Bk, 106M, 106C, and 106Y for each color and a transfer belt 105 as an image carrier. The image forming apparatus is a tandem type in which the process cartridges 106Bk, 106M, 106C, and 106Y are arranged side by side opposed to the transfer belt 105. The transfer belt 105 rotates counterclockwise in FIG. 1. The process cartridges (electrophotography processing units) 106Bk, 106M, 106C, and 106Y are arranged in that order from upstream in the rotation direction of the transfer belt 105. The process cartridges 106Bk, 106M, 106C, and 106Y have the same configuration except that they form toner images in different colors. The process cartridge 106Bk forms a black image, the process cartridge 106M forms a magenta image, the process cartridge 106C forms a cyan image, and the process cartridge 106Y forms a yellow image.

The process cartridges 106Bk, 106M, 106C, and 106Y houses photosensitive elements 109Bk, 109M, 109C, and 109Y, respectively and some other devices as a single unit. The process cartridges 106Bk, 106M, 106C, and 106Y are attached to the image forming apparatus in a detachable manner. Taking the process cartridge 106Bk for a black color as an example, in addition to the photosensitive element 109Bk, the process cartridge 106Bk includes a cleaner blade 113Bk, a discharging unit (not shown), and a charging unit 110Bk. The process cartridge 106C includes a cleaner blade 113C, a discharging unit (not shown), and a charging unit 110C. The process cartridge 106Y includes a cleaner blade 113Y, a discharging unit (not shown), and a charging unit 110Y. The process cartridge 106M includes a cleaner blade 113M, a discharging unit (not shown), and a charging unit 110M. The cleaner blade 113Bk cleans a residual toner remaining on the surface of the photosensitive element 109Bk after the toner passes through a primary transfer nip. The discharging unit discharges the surface of the photosensitive element 109Bk after the cleaning. The charging unit 110Bk uniformly charges the surface of the discharged photosensitive element 109Bk. Other than process cartridge 109Bk used for other colors, i.e., the process cartridges 106M, 106C, and 106Y have substantially the same configuration except that they contain therein different colors. The exposing unit 111 irradiates each of the photosensitive elements 109Bk, 109M, 109C, and 109Y with each corresponding laser light 114Bk, 114M, 114C, and 114Y, serving as the exposure light, corresponding to an image color formed by each of the process cartridges 106Bk, 106M, 106C, and 106Y.

As shown in FIG. 1, the process cartridge 106Bk includes a paddle 106*a* that mixes the toner, a supplying roller 106*b* that supplies the toner, and a developing blade 106*c* that shapes the toner into a flat layer. As shown in FIG. 1, the image forming apparatus includes a pair of conveying rollers 119, a registration sensor 120, a conveying-path sensor 121, a discharging sensor 123, an intermediate-transfer belt cleaner 125 that removes the toner remaining on the transfer belt 105 after the transfer, a waste toner box 130 that collects the residual toner on the photosensitive elements 109 and the transfer belt 105 after the transfer, and a waste toner full-state detection sensor 131 that detects a full-state of the waste toner in the waste toner box 130.

The transfer belt 105 is an endless belt wound between a secondary transfer driving roller 107 that is a driving roller and a transfer belt supporting roller 108. The secondary transfer driving roller 107 is driven to rotate by a driving motor (not shown). The driving motor, the secondary transfer driving roller 107, and the transfer belt tension roller 108 serve as a driving unit that moves the transfer belt 105.

The process cartridge 106Bk is described in detail below. The other process cartridges 106M, 106C, and 106Y have the same configurations as the process cartridge 106Bk. Therefore, descriptions thereof are not repeated.

When an image is formed, the charging unit 110Bk uniformly charges an outer circumferential surface of the photosensitive element 109Bk in a dark condition. The exposing unit 111 exposes the charged surface to the laser light 114Bk corresponding to the black image, thereby forming a latent image. The developing unit 112Bk makes the latent image visible with the black toner. Accordingly, a black toner image is formed on the surface of the photosensitive element 109Bk.

The toner image is transferred onto the transfer belt 105 by a primary transfer roller 115Bk at a position where the photosensitive element 109Bk comes into contact with the transfer belt 105 (primary transfer position). Accordingly, a black toner image is formed on the transfer belt 105. After the toner image is transferred, the cleaner blade 113Bk cleans an unwanted toner remaining on the outer circumferential surface of the photosensitive element 109Bk, and the photosensitive element 109Bk waits for a next image forming operation.

The black image transferred onto the transfer belt 105 at the process cartridge 106Bk is conveyed to the next process cartridge 106M by the transfer belt 105. At the process cartridge 106M, a magenta toner image is formed on the photosensitive element 109M in a similar manner as in the image formed at the process cartridge 106Bk, and the magenta toner image is superimposed onto the black image formed on the transfer belt 105.

The transfer belt 105 is further conveyed to the next process cartridges 106C and 106Y. With a similar process, a cyan toner image formed on the photosensitive element 109C and a yellow toner image formed on the photosensitive element 109Y are sequentially superimposed onto the previously-superimposed toner image and transferred onto the transfer belt 105. Thus, a full-color toner image is formed on the transfer belt 105.

When only the black image is printed, each of the primary transfer rollers 115M, 115C, and 115Y is retracted from each of the corresponding photosensitive elements 109M, 109C, and 109Y, and the above-described image forming process is performed only for the black toner image.

A paper feeding unit including paper feeding trays 101*a* and 101*b*, paper feeding rollers 102*a* and 102*b*, and a pair of registration rollers 103 are arranged below the transfer belt 105. A secondary transfer roller 116 is arranged opposite to the secondary transfer driving roller 107. A secondary transfer nip is formed in such a manner that the secondary transfer driving roller 107 and the secondary transfer roller 116 are opposed each other across the transfer belt 105. A fixing unit 122 and a discharging roller 118 are arranged above the secondary transfer nip.

The paper feeding trays 101*a* and 101*b* stores therein a plurality of sheets 104 serving as a recording medium, in a stacking manner. The top sheet 104 in the paper feeding tray 101*a* comes into contact with the paper feeding roller 102*a*, and the top sheet 104 in the paper feeding tray 101*b* comes into contact with the paper feeding roller 102*b*. When a sheet 104 is delivered from one of the paper feeding trays 101*a* and 101*b*, a driving mechanism (not shown) rotates the corresponding paper feeding roller 102*a* or 102*b* and stops its rotation in a state in which the leading end of the top sheet 104 abuts against the registration rollers 103. The sheet 104 is conveyed, at an appropriate timing, toward the secondary transfer nip to which a transfer bias is applied. The toner image formed on the transfer belt 105 is transferred onto the sheet 104 at the secondary transfer nip. The residual toner that is not transferred onto the sheet 104 is adhered on the transfer belt 105 that has passed through the secondary transfer nip. The residual toner is cleaned by the intermediate-transfer belt cleaner 125.

The sheet 104 passing through the secondary transfer nip passes between a fixing roller and a pressing roller arranged in the fixing unit 122 where the toner image transferred onto a surface of the sheet 104 is fixed with heat and pressure. The sheet 104 is then discharged out of the image forming apparatus by the discharging roller 118.

Figure 2:
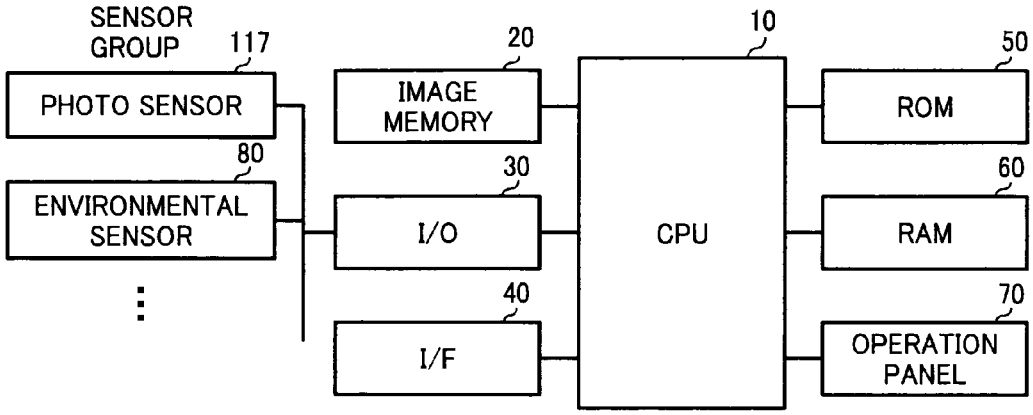
FIG. 2 is a block diagram of an electrical configuration of the image forming apparatus according to the embodiment.

The basic electric configuration of the image forming apparatus according to the embodiments of the present invention is described with reference to a block diagram illustrated in FIG. 2. The image forming apparatus includes a central processing unit (CPU) 10, an image memory 20, an input-output port (I/O) 30 (input-output unit), an interface (I/F) 40 (interface unit), a read only memory (ROM) 50, a random access memory (RAM) 60, and an operation panel 70. The CPU 10 controls units included in the image forming apparatus according to computer programs stored in the ROM 50. The image memory 20 temporarily stores image data contained in printing data. The I/O 30 controls input/output of electric components, such as image forming units and sensors. The I/F 40 receives printing data and query responses from a user from, for example, a personal computer and a server connected by cables. The ROM 50 stores therein computer programs that control the image forming apparatus. The RAM 60 temporarily stores various kinds of information on the image forming apparatus. The operation panel 70 is a display unit with which a user finds a status of the image forming apparatus or changes settings of the operation of the image forming apparatus. A group of sensors includes a later-described photo sensor 117 and an environmental sensor 80 that are connected to the I/O 30.

The photo sensor 117 is arranged opposite to the transfer belt 105. The photo sensor 117 includes a light emitting diode (LED) (not shown) that emits light toward the transfer belt 105 and a photodiode (not shown) that receives the light reflected from the transfer belt 105, which are paired and opposite to each other.

The environmental sensor 80 detects temperature and humidity around the image forming apparatus. Example devices that can be used for detecting the temperature include a thermocouple device, a device in which resistivity changes, a pyroelectric device, and a thermomagnetic device. The thermocouple device detects a thermoelectromotive force, generated at a junction of two different metals or a junction of a metal and a semiconductor, as a signal. The device in which resistivity changes detects a temperature using a property of a metal or a semiconductor in which resistivity varies according to the temperature. The pyroelectric crystal device generates an electric potential on a surface of the device because charges in the crystal are non-uniformly distributed due to a rise in temperature. The thermomagnetic device detects a change in magnetic property caused by a temperature. Example devices that can be used for detecting humidity include an optical measuring device and a humidity sensor. The optical measuring device measures light absorption of $H_2O$ or a hydroxyl group. The humidity sensor measures a change in electric resistance of a material that absorbs water vapor.

Image density adjustment of the image forming apparatus according to the embodiment of the present invention is described in detail below. With an electrophotography-type image forming apparatus, image density varies caused by environmental changes, such as changes in temperature and humidity, and degradation of the quality over time. Therefore, the image density needs to be corrected according to changes in the images at a predetermined timing. The specific predetermined timing includes a timing when a main power supply is turned on, when a predetermined time is elapsed in a standby mode, when a predetermined number or more of images are printed, and change in temperature and humidity.

Figure 3:
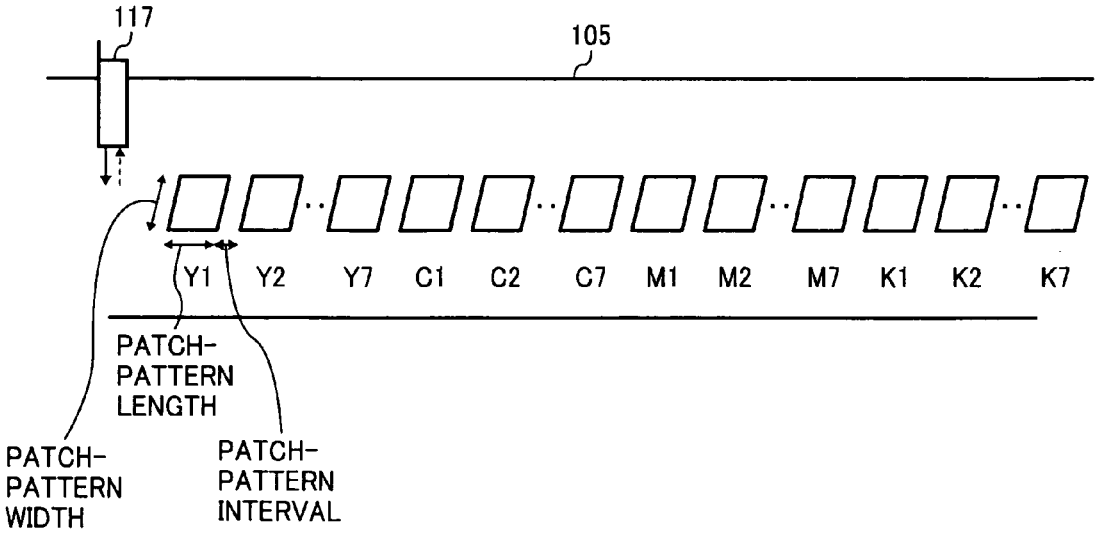
FIG. 3 is a schematic diagram illustrating patch patterns formed on a transfer belt.

Specific density adjustment is described in detail below. When a timing at which the density adjustment needs to be performed is determined, the surface of each of the rotating photosensitive elements 109Bk, 109M, 109C, and 109Y is uniformly charged with a rotation thereof. Each of the photosensitive elements 109Bk, 109M, 109C, and 109Y is irradiated with the corresponding laser light 114Y, 114C, 114M, and 114Bk in which output power gradually increases, and the latent images for patch patterns are formed on each of the photosensitive elements 109Bk, 109M, 109C, and 109Y. The latent images formed on each of the photosensitive elements 109Bk, 109M, 109C, and 109Y are developed in the corresponding developing unit 112Y, 112C, 112M, and 112Bk, and the patch patterns are formed on the transfer belt 105. FIG. 3 is a schematic diagram illustrating the patch patterns formed on the transfer belt 105. As shown in FIG. 3, seven patch patterns with different density for each color are formed on the transfer belt 105. The patch patterns formed on the transfer belt 105 are conveyed, with endless movement of the transfer belt 105, to a position where the transfer belt 105 is opposed to the photo sensor 117. The photo sensor 117 irradiates the transfer belt 105 with the laser light and detects an amount of the light reflected from the patch patterns formed on the transfer belt 105 (hereinafter, "reflected light level"). The detected and reflected light level is converted to an adhering amount of a toner that is accumulated as density pattern data for each color. Approximation of laser power and the adhering amount of toner are calculated from the density pattern data. The laser power, from which a target adhering amount of toner is obtained, is determined based on the approximation and set as a corrected image forming condition. The patch patterns passing through a position opposing to the photo sensor 117 are cleaned by the intermediate-transfer belt cleaner 125.

Figure 4:
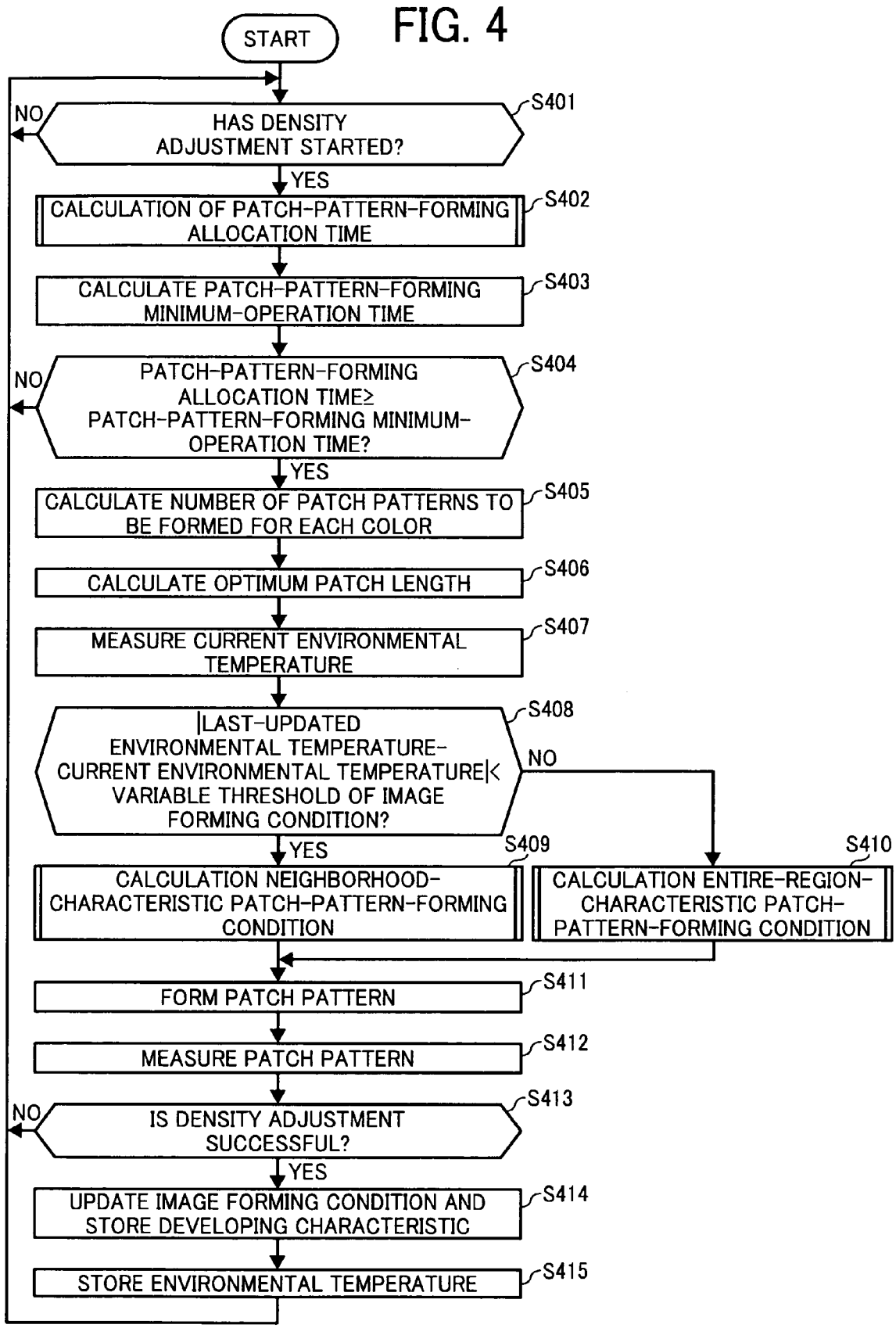
FIG. 4 is a flowchart of a density adjustment process used in an image forming apparatus according to a first embodiment of the present invention.

FIG. 4 is a flowchart of a main process procedure of density adjustment according to the first embodiment. The CPU 10 performs the density adjustment. When the CPU 10 determines whether the density adjustment is to be performed (Step S401). If the density adjustment is to be performed (Yes at Step S401), the CPU 10 calculates a patch-pattern-forming allocation time (see FIG. 5) (Step S402).

Figure 5:
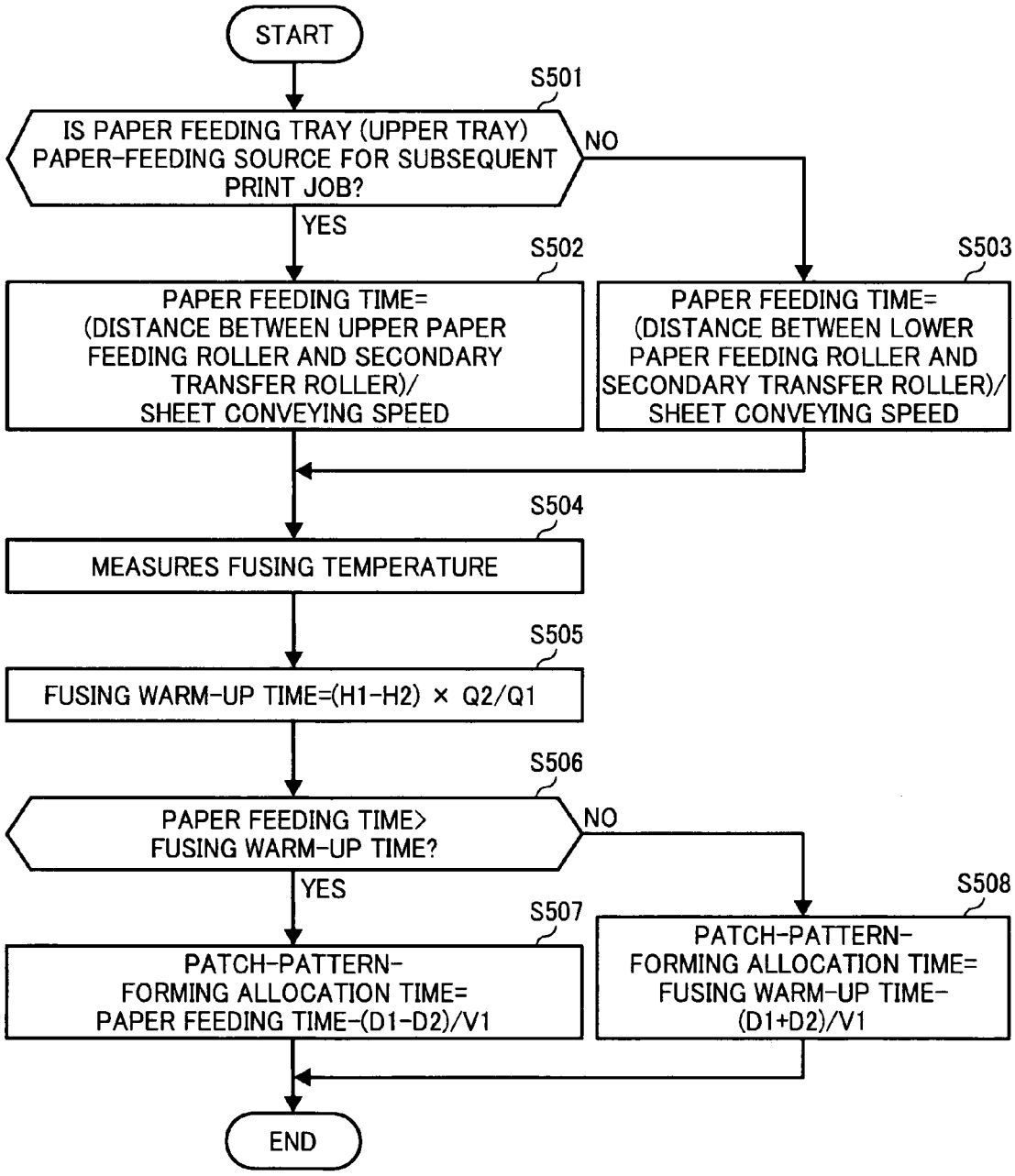
FIG. 5 is a flowchart of a process of calculating patch-pattern-forming allocation time.

FIG. 5 is a flowchart of the detailed operation of calculating the patch-pattern-forming allocation time shown in FIG. 4. Time for conveying the sheet 104 from the paper feeding roller 102 to the secondary transfer roller 116 is obtained (hereinafter, "paper-feeding time"). Because a distance between the feeding roller 102 and the secondary transfer roller 116 differs depending on a paper-feeding source, the paper feeding time varies accordingly; therefore, the CPU 10 determines whether the paper-feeding source is the paper-feeding tray 101*a*, i.e., upper tray (Step S501). When the paper-feeding source of the subsequent print job is the paper-feeding tray 101*a*, (Yes at Step S501), the CPU 10 calculates the paper-feeding time by dividing a distance between the paper feeding roller 102*a* and the secondary transfer roller 116 by a sheet conveying speed (Step S502). On the other hand, when the paper-feeding source of the subsequent print job is the paper-feeding tray 101*b* i.e., a lower tray (No at Step S501), the CPU 10 calculates the paper feeding time by dividing a distance between the paper feeding roller 102*b* and the secondary transfer roller 116 by the sheet conveying speed (Step S503).

Alternatively, values can be stored in the ROM 50 in advance instead of calculating the paper-feeding time. In such a case, the sheet conveying speed differs depending on a sheet type. For example, a thick sheet is conveyed at a low speed in such a manner that the thick sheet is sufficiently heated when it is fixed; therefore, paper-feeding speeds represented by a parameter indicative of the paper-feeding sources and the sheet types need to be stored in the ROM 50 in advance.

A thermistor (not shown), which is commonly used in a copying machine and the like, measures the fixing temperature of the fixing roller in the fixing unit 122 (Step S504). The CPU 10 calculates a warm-up time until the fixing unit 122 reaches a predetermined temperature (hereinafter, "fixing warm-up time" in the embodiments and "fixing WUP time" in the drawings) based on the measured fixing temperature (hereinafter, "fixing measurement temperature").

The fixing warm-up time is given by fixing warm-up time= (H1−H2)×Q2/Q1 (Step S505), where Q1 [Kcal/second (sec)] is a heating capability of the fixing unit 122, Q2 [Kcal/° C.] is a heat capacity required to raise the fixing unit 122 (actually, fixing rollers) by 1° C., H1 [° C.] is a fixing target temperature capable of printing, and H2 [° C.] is a fixing measurement temperature. In the embodiment, the fixing warm-up time is calculated using the above-described equation; however, the fixing warm-up time can be obtained from a table value like shown in FIG. 6 stored in the ROM 50.

The CPU 10 compares the paper feeding time with the fixing warm-up time (Step S506). FIGS. 7A and 7B are schematic diagrams illustrating the relations between the paper-feeding time and the fixing warm-up time (startup time). FIG. 7A is a schematic diagram illustrating a case in which the paper-feeding time is longer than the fixing warm-up time. FIG. 7B is a schematic diagram illustrating a case in which the paper-feeding time is equal to or less than the fixing warm-up time. When the paper feeding time is longer than the fixing warm-up time (Yes at Step S506), the CPU 10 calculates a patch-pattern-forming allocation time given by paper-feeding time−(D1+D2)/V1, where D1 [millimeter (mm)] is a distance between an exposure position of the uppermost photosensitive element (Bk) and the secondary transfer roller 116, D2 [mm] is a distance between the secondary transfer roller 116 and the fixing rollers in the fixing unit 122, and V1 [mm/sec] is linear velocity of the photosensitive element 109 and surface velocity of the transfer belt 105 (Step S507).

In other words, the CPU 10 calculates a time difference between the time required for conveying the sheet 104 from the paper feeding roller 102 to the secondary transfer roller 116 (paper-feeding time−D2/V1) and a time for conveying the image from the primary transfer nip to the secondary nip (D1/V1) (hereinafter, "secondary transfer time").

The above-described patch-pattern-forming allocation time is a patch-pattern-forming time in which a downtime caused by the density adjustment does not occur. When the paper feeding time is longer than the fixing warm-up time, when the time from when a paper feeding starts to when the leading edge of the sheet reaches the secondary transfer roller 116 (paper-feeding time) is five seconds, and when the time (D1/V1) from when exposure starts to when the leading edge of the image reaches the secondary transfer roller 116 is two seconds, the standby time is two seconds. This indicates that the exposure needs to be started two seconds after the sheet 104 is fed; therefore, the downtime caused by the density adjustment does not occur even when patch patterns are formed during this time.

On the other hand, when the fixing warm-up time is longer than the paper feeding time (No at Step S506), the CPU 10 calculates the patch-pattern-forming allocation time given by fixing warm-up time−(D1+D2), where D2 is a distance between the secondary transfer roller 116 and the fixing rollers in the fixing unit 122 (Step S508).

For example, when the fixing warm-up time is 10 seconds, when the secondary transfer time (D1/V1) is three seconds, and when the time for conveying the leading edge of the sheet 104 from the secondary transfer roller 116 to the fixing unit 122 is one second (D2/V1), the exposure of print image data needs to be started six seconds after the warm up is started; therefore, the downtime caused by the density adjustment does not occur even when the patch patterns are formed during this time.

The CPU 10 calculates the patch-pattern-forming allocation time in this way.

Referring back to FIG. 4, the CPU 10 calculates a patch-pattern-forming minimum-operation time (Step S403). The patch-pattern-forming minimum-operation time is calculated from a time spent for forming the minimum number of patch patterns required for the density adjustment and is given by (D3+D4)×N1×4/V1, where D3 [mm] is a reference patch-pattern length, D4 [mm] is a patch-pattern interval, and N1 [piece] is the minimum required number of patch patterns that is to be formed per color and required for obtaining a developing characteristic when the density adjustment is performed.

The CPU 10 can calculate the minimum time required for forming the patch patterns for the density adjustment. Accordingly, unnecessary toner consumption can be prevented by stopping the density adjustment without forming the patch patterns when the patch-pattern-forming minimum-operation time is shorter than the patch-pattern-forming allocation time.

The developing characteristic in the first embodiment indicates the relation between a power of the laser light 114 (hereinafter, "laser power") and density of the toner image to be formed. To obtain the developing characteristic, the patch patterns are formed by converting the laser power, and toner density of the patch patterns is measured, thereby the relation between the laser power and the toner density is modeled. Specifically, a formula for obtaining the developing characteristic is established using a least-squares method. The minimum required number of patch patterns to be formed for each color is a value determined in advance, instead of being calculated. A desirable number of patch patterns is three in consideration of coping with non-linear characteristics.

The CPU 10 compares the patch-pattern-forming minimum-operation time with the patch-pattern-forming allocation time (Step S404). When the patch-pattern-forming minimum-operation time is longer than the patch-pattern-forming allocation time, the CPU 10 does not perform the density adjustment. When the patch-pattern-forming allocation time is longer than the patch-pattern-forming minimum-operation time, the CPU 10 calculates the number of patch patterns to be formed per color given by T1×V1/{(D3+D4)×4}, where T1 [sec] is a patch-pattern-forming allocation time. The result value is an integer by omitting fractions.

The CPU 10 calculates the optimum patch-pattern length given by {(T1×V1)×D4×N2×4}/N2, where N2 [pieces] is the number of patch patterns to be formed per color (Step S406).

The patch-pattern length can be maximized by making the patch-pattern interval D4 large to obtain an optimum patch-pattern length. Even when the patch patterns are formed with the same laser power, the density differs depending on the region of the patch pattern being measured because the toner density is uneven in an identical patch pattern. Therefore, when the toner density of the patch pattern is measured, the identical patch pattern is sampled for several times by the photo sensor 117 and the measured value is averaged, which makes it possible to obtain the toner density value with high accuracy. Accordingly, the longer the patch-pattern length is, the more sampling can be obtained, and therefore, the measurement accuracy can be improved.

The patch patterns can be formed within the patch-pattern-forming allocation time by calculating the number of patch patterns per color based on the minimum required length for a reference patch-pattern and patch-pattern intervals for optimum density adjustment. An accurate toner density of the patch patterns can be measured by elongating a patch-pattern length according to the patch-pattern-forming allocation time even when nonuniform density occurs in the patch patterns.

The environmental sensor 80 measures the current environmental temperature (Step S407). The CPU 10 calculates a difference between the measured environmental temperature and an environmental temperature at which the image forming condition is updated last time. In this case, the environmental temperature is an ambient temperature around the image forming apparatus. The CPU 10 determines whether a difference between the last-updated environmental temperature and the current environment temperature is smaller than a variable threshold of image forming condition set in advance (Step S408). When the difference is smaller than the threshold that is set in advance, the CPU 10 determines that the accuracy of the current image forming condition is high and calculates a patch-pattern-forming condition that obtains the developing characteristic near the current image-forming condition (Step S409). On the other hand, when the difference is larger than the threshold that is set in advance, the CPU 10 determines that the accuracy of the current image forming condition is low and calculates a later-described entire-region-characteristic patch-pattern-forming condition (Step S410). After completion of the calculation process of Step S409 or Step S410, the CPU 10 forms the maximum patch pattern in length obtained at Step S406 and measures the toner density of the formed patch pattern (Steps S411 and S412). When adjustment of the toner density is successfully performed, the CPU 10 updates the image forming condition and the developing characteristic and stores the environmental temperature at that time (Steps S413, S414, and S415).

Accordingly, the accuracy of the current image-forming condition can be evaluated based on a difference between the current environmental temperature and the environmental temperature at which density adjustment is performed due to a change in image forming condition (laser power value in the embodiments) last time (hereinafter, "last-updated environmental temperature").

Figure 8:
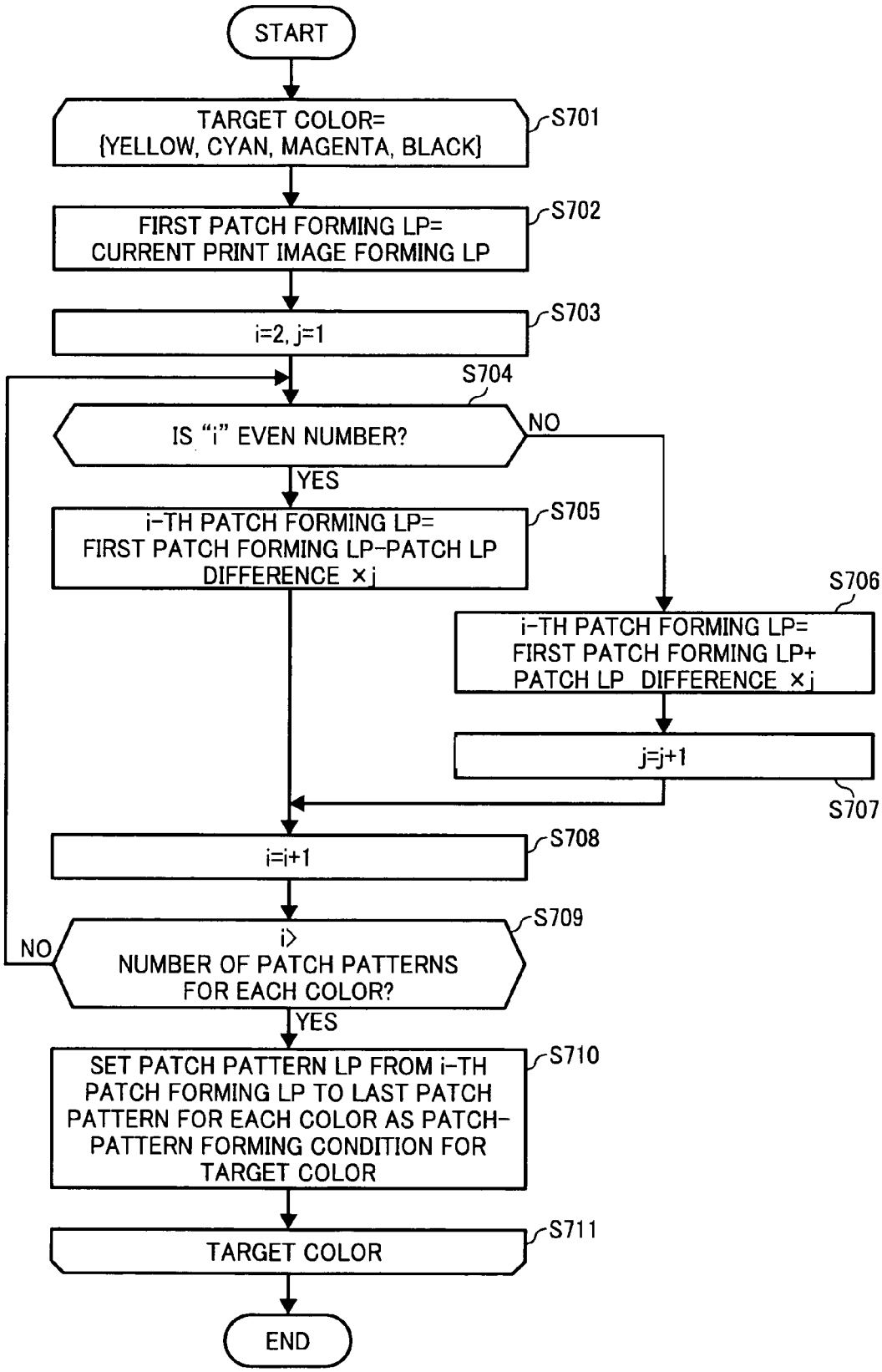
FIG. 8 is a flowchart of a process of calculating a patch-pattern-forming condition for obtaining a developing characteristic near the current image-forming condition.

The accuracy of the image-forming condition is obtained by estimating the amount of change in the image-forming condition. When the difference between the current environmental temperature and the last-updated environmental temperature is small, the optimum image-forming condition is near the current image-forming condition; therefore, the accuracy is assumed to be high. FIG. 8 is a flowchart of detailed process procedure of the developing characteristic near the current image-forming condition. The laser power used for forming each of the corresponding patch patterns is set at the specified patch-pattern laser power difference (hereinafter "patch LP difference"), with reference to the laser power of the current print image to be formed.

FIG. 8 is a flowchart of a calculation process of the laser power used for forming each of the patch patterns in each corresponding color. The CPU 10 performs the calculation process for each of the colors (Bk, M, C, and Y). The CPU 10 sets a target color for each color (Step S701). The laser power (LP) used for forming the current print image for that color is defined as the laser power used for forming a first patch pattern (hereinafter "first patch forming LP) (Step S702), and "i" is set to 2 (Step S703). The CPU 10 determines whether "i" is an even number (Step S704). When "i" is an even number (Yes at Step S704), the CPU 10 calculates the laser power used for forming an i-th patch pattern (hereinafter "i-th patch forming LP") given by the first patch forming LP−the patch LP difference×j (Step S705). On the other hand, "i" is not an even number (No at Step S704), the CPU 10 calculates the i-th patch forming LP given by the first patch forming LP+the patch LP difference×j (Step S706) and increments "j" by one (Step S707). After processing Step S705 or Step S707, the CPU 10 increments "i" by one (Step S708), and determines whether "i" is larger than the number of patch patterns for each color (Step S709). When "i" is not larger than the number of patch patterns per color (No at Step S709), the process control returns to Step S704. When "i" is the number of patch patterns per color (Yes at Step S709), the CPU 10 determines a difference between the i-th patch forming LP and the laser power of the last patch pattern per color as the patch-pattern forming condition for the target color (Steps S710 and S711).

The calculation process shown in the flowchart in FIG. 8 is designed to obtain the characteristic near the current image-forming condition. Accordingly, the laser power (LP) in each color for forming the current print image is set to be a median of the laser power used for forming the patch patterns. For example, the calculation result of the neighborhood-characteristic patch-pattern-forming condition in, for example, yellow is as below:

the first patch forming LP=200 watts (W) (the laser power used for forming the current printing image is the median)

the second patch forming LP=190 W (calculated from: the first patch forming LP−patch LP difference×1)

the third patch forming LP=210 W (calculated from: the first patch forming LP+patch LP difference×1)

the fourth patch forming LP=180 W (calculated from: the first patch forming LP−patch LP difference×2)

the fifth patch forming LP=220 W (calculated from: the first patch forming LP+patch LP difference×2), where the laser power used for forming the current print image is 200 W, the number of patch patterns per color is five, patch LP difference is 10 W.

In the above calculation, the patch-pattern-forming condition is determined by calculating the image-forming conditions for each of the threshold difference in increasing order of difference between the current image-forming condition and the above-described laser power used for forming each patch pattern. Accordingly, the developing characteristic near the current image-forming condition can be detected with high accuracy. Specifically, in this case, the CPU 10 determines the current laser power of 200 W as the closest laser power that can be obtained the optimum toner density, and thus obtains the image forming condition with the laser power ranging from 180 W to 220 W based on the optimum median value of 220 W.

Figure 9:
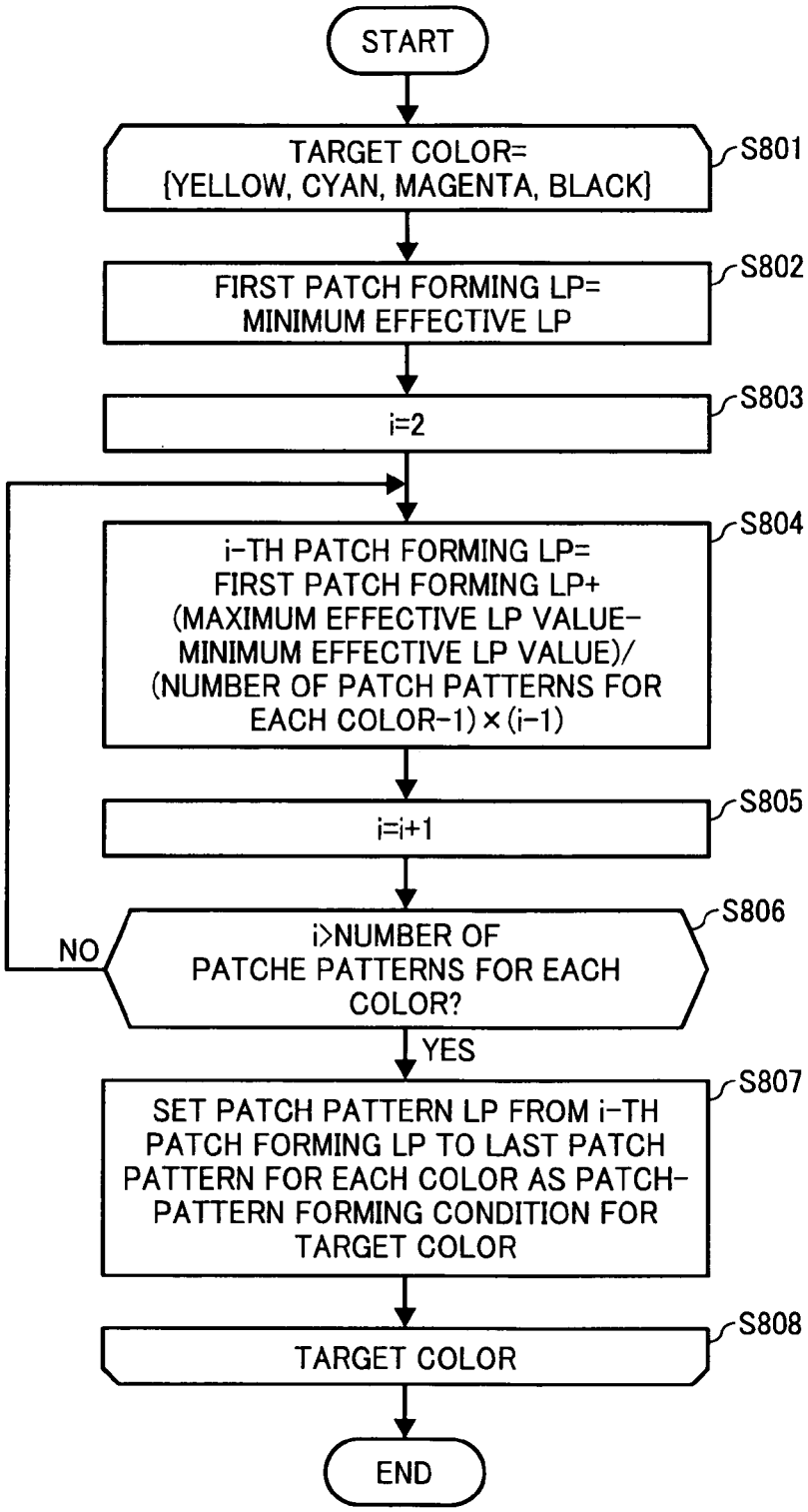
FIG. 9 is a flowchart of a process of calculating each patch-pattern-forming condition for obtaining a developing characteristic of the entire region of an image-forming condition.

When the difference is larger than the threshold (No at Step S408 in FIG. 4), the CPU 10 determines that the accuracy of the current image-forming condition is low and calculates each of the patch-pattern-forming conditions. The calculation of each of the patch-pattern-forming conditions is performed to obtain the developing characteristic when the entire region of the image-forming condition, i.e., when the laser power used for forming each of the patch patterns in each corresponding color, is set to a value obtained by dividing a difference value between the minimum value and the maximum value of the effective laser power used for forming the patch patterns by the number of patch patterns per color. The process thereof in detail is illustrated in a flowchart in FIG. 9. The CPU 10 performs this process for each of the colors (Bk, M, C, and Y). The CPU 10 sets a target color for each color (Step S801). The minimum value of the effective laser power (LP) of the current print image to be formed for that color is defined as the first patch forming LP (Step S802), "i" is set to 2 (Step S803). The CPU 10 calculates the i-th patch forming LP given by the first patch forming LP+(the maximum effective LP value−the minimum effective LP value)/(the number of patch patterns per color−1)×(i−1) (Step S804). The CPU 10 increments "i" by one (Step S805) and determines whether "i" is larger than the number of patch patterns per color (Step S806). If "i" is not larger than the number of patch patterns per color (No at Step S806), the process control returns to Step S804. If "i" is larger than the number of patch patterns per color (Yes at Step S806), the CPU 10 determines the difference between the i-th patch forming LP and the laser power of the last patch pattern per color as the patch-pattern forming condition for the target color (Steps S807 and S808).

As described above, the laser power used for forming the patch patterns for each color is set by dividing a difference value between the minimum value and the maximum value of the effective laser power used for forming the patch patterns by the number of patch patterns per color. In the first embodiment, the laser power is used for the target color for the patch-pattern-forming condition; however, the configuration is not limited thereto. For example, a parameter that determines development potential such as a developing bias can be used. The accuracy of the image-forming condition is evaluated based on the difference between the current environmental temperature and the last-updated environmental temperature; however, the configuration is not limited thereto. For example, it is also possible to evaluate the image-forming condition based on differences in environment humidity, cumulative number of print sheets, traveling distance of the photosensitive element, and replacement of the developing unit due to aging.

The CPU 10 forms the patch patterns under the patch-pattern forming condition calculated in the process shown in FIGS. 7A and 7B or FIG. 8 and measures the toner density of the patch patterns. The CPU 10 obtains the developing characteristic from the measurement result of the toner density and calculates the image-forming condition at which the print image is formed. If the calculated image-forming condition is satisfied, the CPU 10 determines that the density adjustment is successful and stores therein the image-forming condition and the developing characteristic. If the calculated image-forming condition is not satisfied, the CPU 10 determines that the density adjustment fails and stops the density adjustment. The CPU 10 stores therein the environmental temperature obtained when the density adjustment is successful and completes the density adjustment, and then the process control returns to Step S401 (see Steps S411 to S415 in FIG. 4).

The CPU 10 evaluates the accuracy of the current image-forming condition during the density adjustment. When the accuracy is high, the CPU 10 calculates the number of patch patterns, a patch-pattern length, and the image-forming condition for the optimum patch pattern that can obtain the developing characteristic near the current image-forming condition within a predetermined time and forms the patch patterns. When the accuracy is low, the CPU 10 calculates the number of patch patterns, patch-pattern lengths, and the image-forming condition for the optimum patch pattern that can obtain the developing characteristic in the entire region of the image-forming condition and forms the patch patterns. Accordingly, the accurate density adjustment can be performed within the predetermined time without the downtime caused by the density adjustment.

Figure 10:
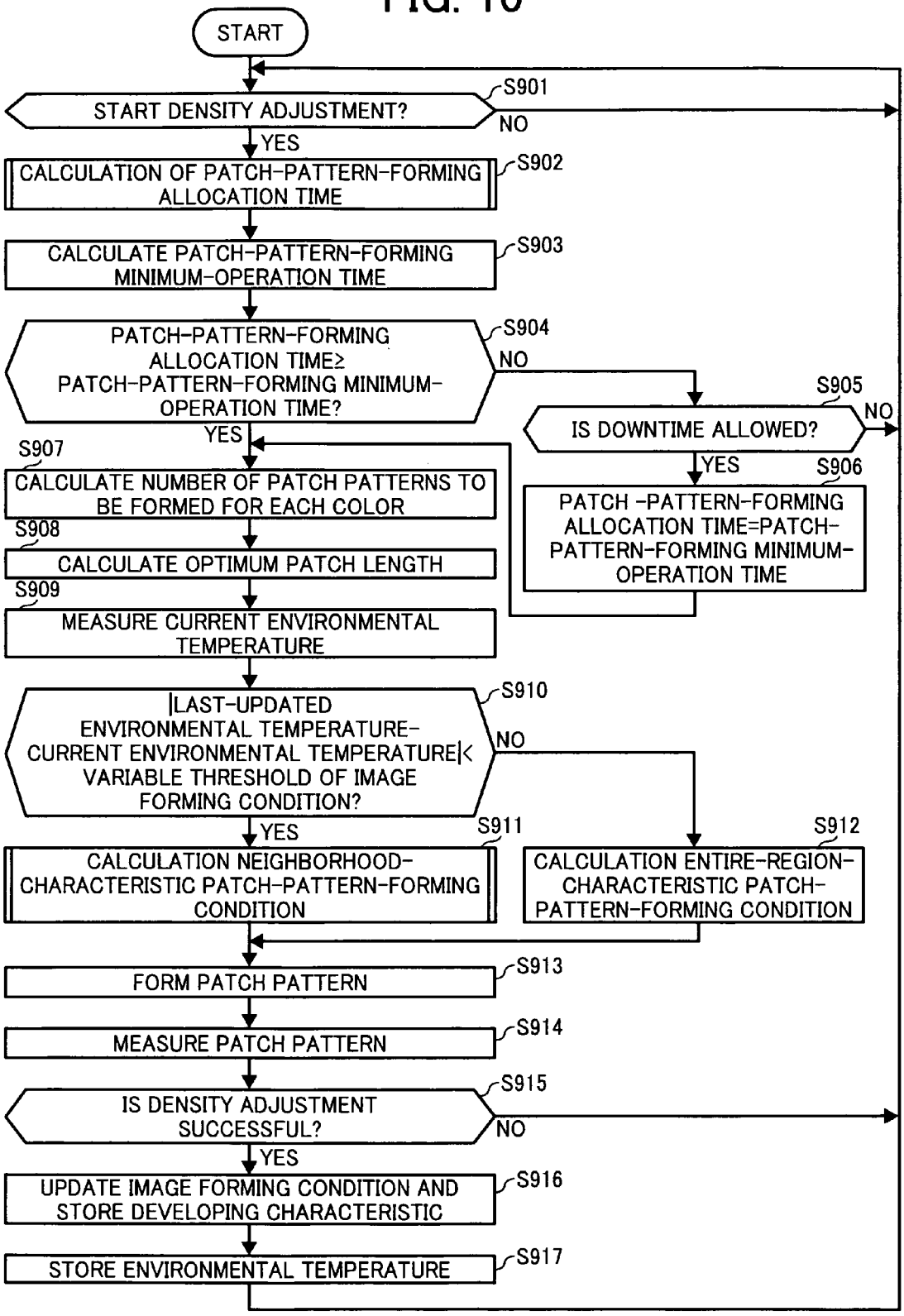
FIG. 10 is a flowchart of a density adjusting process used in an image forming apparatus according to a second embodiment of the present invention.

A second embodiment of the present invention is described with reference to FIGS. 10 to 12. FIG. 10 is a flowchart of an example of a density adjustment process according to the second embodiment. The CPU 10 performs the operation. The configuration of the second embodiment is modified a part of configuration of the first embodiment, and therefore, the same explanation is not repeated.

The process controls performed at Step S901 to S904 illustrated in the flowchart in FIG. 10 is similar to those performed at Step S401 to S404 in FIG. 4. When the determination at Step S904 is negative, the CPU 10 further determines whether the downtime is accepted by the user via a prescribed keypad at the operation panel 70 (Step S905). If the downtime is accepted, the CPU 10 determines that the patch-pattern-forming allocation time is the patch-pattern-forming minimum-operation time (Step S906). After the CPU 10 performs a process of Step S906 or the determination at Step S904 is positive, the CPU 10 performs the same process as Step S405 and the subsequent processes shown in FIG. 4, i.e., from Step S907 to Step S917.

As shown in FIG. 10, the CPU 10 compares the patch-pattern-forming minimum-operation time with the patch-pattern-forming allocation time. When the patch-pattern-forming minimum-operation time is longer than the patch-pattern-forming allocation time (No at Step S904), the CPU 10 confirms whether the user accepts the downtime due to the density adjustment (Step S905). When the user does not accept the downtime (No at Step S905), the CPU 10 stops the density adjustment. When the user accepts the downtime (Yes at Step S905), the CPU 10 determines that the patch-pattern-forming allocation time is the patch-pattern-forming minimum-operation time and calculates the number of patch patterns per color (Steps S906 and S907).

When the user accepts the downtime due to the density adjustment, the CPU 10 extends the patch-pattern-forming allocation time to the patch-pattern-forming minimum-operation time; therefore, the density adjustment can be performed.

Figure 11:
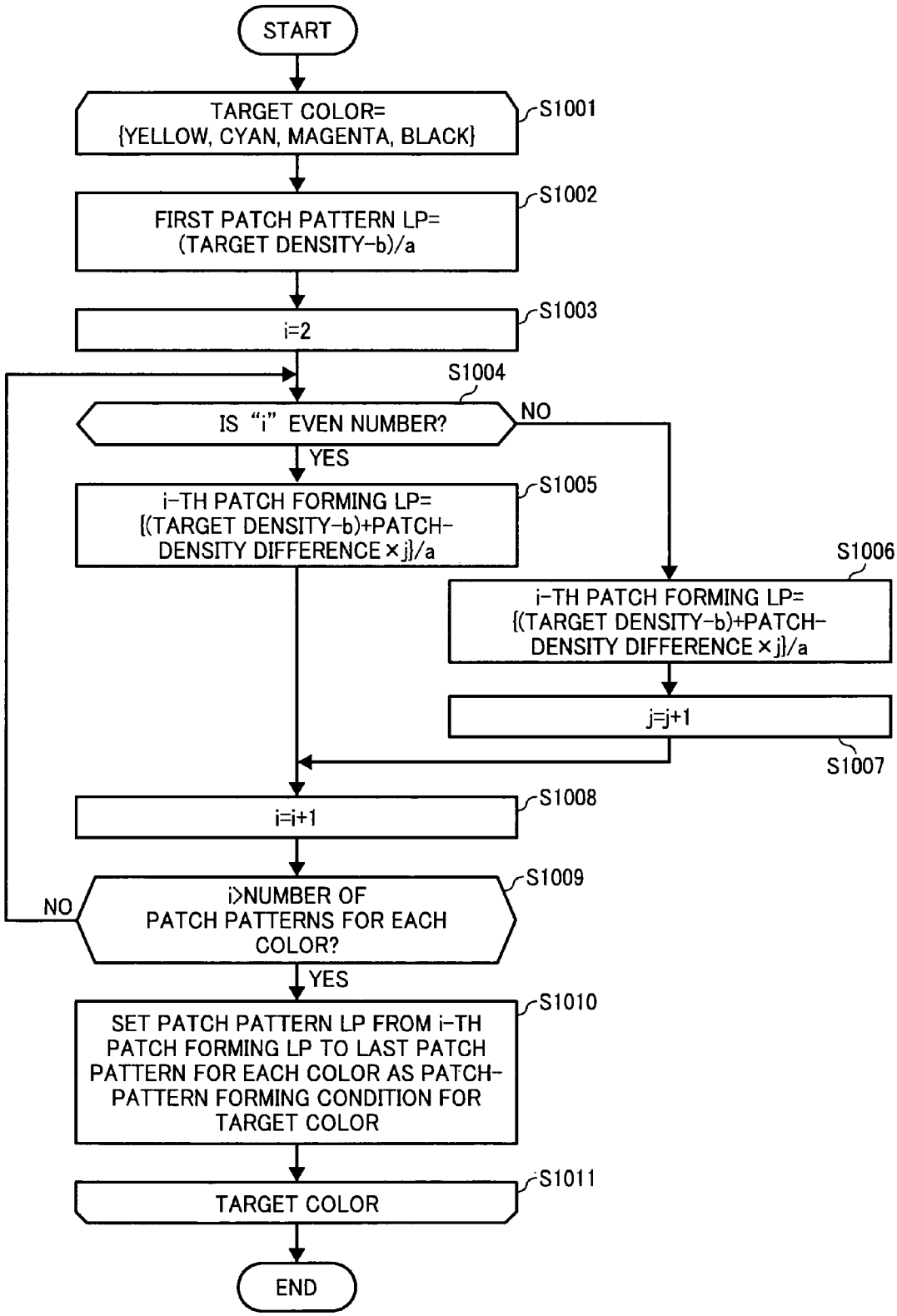
FIG. 11 is a flowchart of a process of calculating patch-pattern-forming condition for obtaining a developing characteristic near the current image-forming condition according to the second embodiment.

FIG. 11 is a flowchart illustrating a process procedure of each patch-pattern-forming condition for obtaining the developing characteristic near the current image-forming condition. The CPU 10 performs this process for each of the colors (Bk, M, C, and Y). In the flowchart in FIG. 11, the CPU 10 sets the target color for each color (Step S1001). The first patch forming LP is set to a value given by "(target density−b)/a" (Step S1002), and "i" is set to 2 (Step S1003). The CPU 10 determines whether "i" is an even number (Step S1004). When the determination at Step S1004 is positive, the CPU 10 calculates the i-th patch forming LP given by {(target density−b)−patch-density difference×j}/a. On the other hand, when the determination at Step S1004 is negative, the CPU 10 calculates the i-th patch forming LP given by {(target density−b)+patch-density difference×j}/a (Step S1006). After processing Step S1005 or Step S1006, the CPU 10 performs the same process shown in FIG. 4 (Steps S1007 to S1011).

Figure 12:
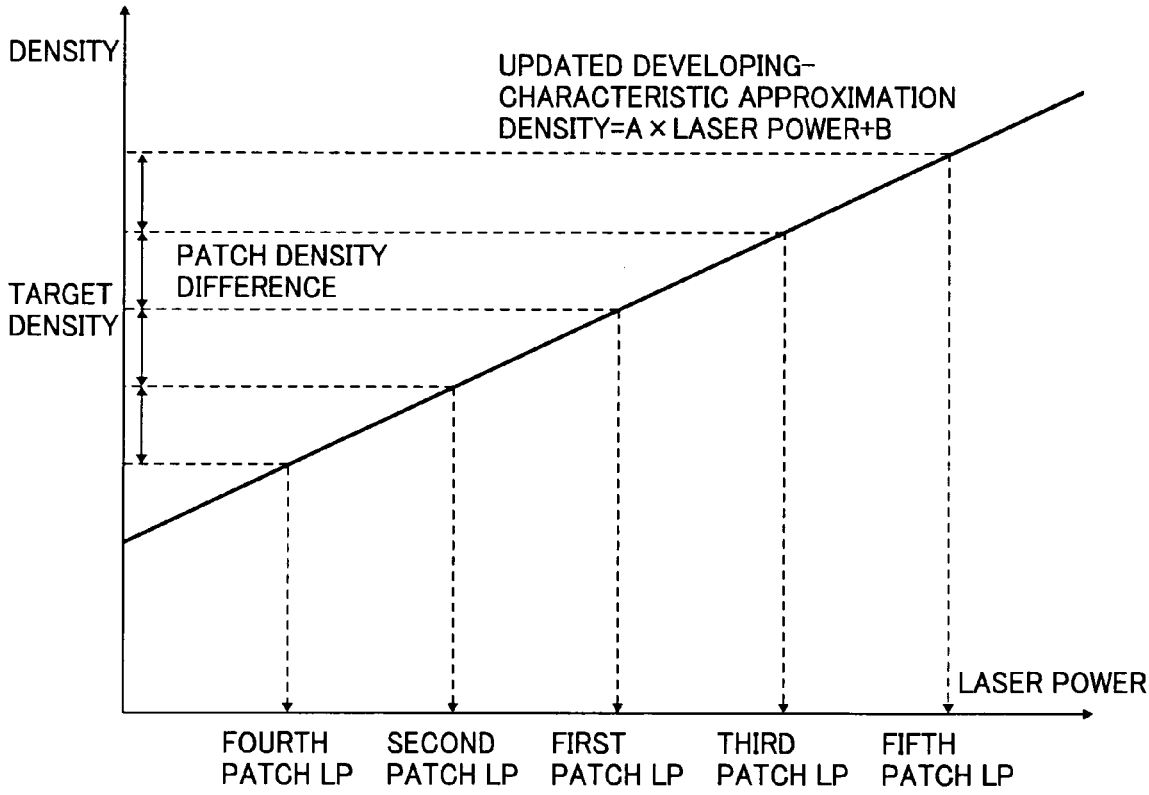
FIG. 12 is a graph for explaining a setting of laser power, at which patch patterns for each color are formed, at intervals of patch pattern density.

FIG. 12 is a graph for explaining an example of the process shown in FIG. 11. As shown in FIG. 12, the CPU 10 sets the laser power for forming each patch pattern, based on the laser power that satisfies a target adhering amount of the toner, at a predetermined patch-density difference using approximation for the developing characteristic obtained when the image-forming condition is updated last time (hereinafter, "updated developing-characteristic approximation").

Accordingly, based on the developing characteristic obtained when the density adjustment is successfully performed last time, the patch-pattern-forming condition is determined by calculating the image-forming conditions for each threshold difference in increasing order of difference between the target adhering amount of the toner and the toner density of the patch patterns, which makes it possible to detect the developing characteristic near the current image-forming condition with high accuracy. It is also possible to accurately detect the developing characteristic in the entire region, in which the image-forming condition is satisfied, by dividing a difference value between the upper limit and the lower limit indicative of the image-forming condition by the number of patch patterns, obtaining regular intervals, and setting the obtained result as the patch-pattern-forming condition.

As described above, according to one aspect of the present invention, a developing characteristic near target density can be efficiently measured within a predetermined time, without a downtime due to density adjustment.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms a plurality of patch patterns on an image carrier, measures densities of the patch patterns formed on the image carrier, and updates an image forming condition for the patch patterns stored in a storing unit based on a result of measuring the density of the patch patterns, the image forming apparatus comprising:

a first calculating unit that calculates an allocation time required for forming the patch patterns;

a second calculating unit that calculates a maximum patch-pattern length of the patch patterns that can be formed within the allocation time based on a number of patch patterns that can be formed within the allocation time; and a first setting unit that calculates a difference between a first environmental temperature around the image forming apparatus and a second environmental temperature at which the image forming condition stored in the storing unit is set, compares the difference with a predetermined threshold, and newly sets an image forming condition for the patch patterns based on a result of comparing the difference and the threshold, wherein when the difference is smaller than the threshold, the first setting unit newly sets a region near a last updated image forming condition that is stored in the storing unit as an image forming condition for the patch patterns to be formed in the maximum patch-pattern length, and when the difference is larger than the threshold, the first setting unit newly sets an entire region of the image forming condition that can be set by the image forming apparatus as an image forming condition for the patch patterns to be formed in the maximum patch-pattern length.

2. The image forming apparatus according to claim 1, further comprising:

a sheet accommodating unit that accommodates a sheet;

a transfer unit that transfers an image formed on the image carrier onto the sheet based on image data to be printed; and a feeding unit that feeds the sheet from the sheet accommodating unit to the transfer unit, wherein the first calculating unit sets a sheet feeding time during which the feeding unit conveys the sheet from the sheet accommodating unit to a transfer portion of the transfer unit as the allocation time.

3. The image forming apparatus according to claim 2, further comprising a fixing unit that fixes the image transferred onto the sheet, wherein the first calculating unit calculates the allocation time required for forming the patch patterns based on a warm-up time of the fixing unit.

4. The image forming apparatus according to claim 3, wherein the first calculating unit sets either one of the warm-up time and the sheet feeding time which is longer as the allocation time.

5. The image forming apparatus according to claim 1, further comprising a third calculating unit that calculates a minimum operation time taken for forming a minimum necessary number of patch patterns for performing a density adjustment, wherein the third calculating unit compares the minimum operation time with the allocation time, and when the minimum operation time is longer than the allocation time, stops the density adjustment.

6. The image forming apparatus according to claim 1, further comprising:

a third calculating unit that calculates a minimum operation time taken for forming a minimum necessary number of patch patterns for performing a density adjustment; and a second setting unit that receives an acceptance of a downtime caused by the density adjustment from a user, and sets the downtime, wherein the second setting unit compares the minimum operation time with the allocation time, and when the minimum operation time is longer than the allocation time and when the user acceptance is set, extends the allocation time up to the minimum operation time.

7. The image forming apparatus according to claim 1, wherein the second calculating unit determines number of patches for each color as $(T1 \times V1)/\{(D1+D2) \times \text{number of colors}\}$, where D1 is reference patch-pattern length, D2 is patch-pattern interval, T1 is patch-pattern-forming allocation time, and V1 is image conveying speed of the image carrier.

8. The image forming apparatus according to claim 1, wherein the second calculating unit calculates the maximum patch-pattern length as $\{(T1 \times V1) - D2 \times N1 \times \text{number of colors}\}/N1$, where D2 is patch-pattern interval, T1 is patch-pattern-forming allocation time, V1 is image conveying speed of the image carrier, and N1 is the number of patch patterns.

9. A computer program product comprising a computer-usable medium having computer-readable program codes embodied in the medium for forming an image in an image forming apparatus that forms a plurality of patch patterns on an image carrier, measures densities of the patch patterns formed on the image carrier, and updates an image forming condition for the patch patterns stored in a storing unit based on a result of measuring the density of the patch patterns, the program codes when executed causing a computer to execute:

first calculating including calculating an allocation time required for forming the patch patterns;

second calculating including calculating a maximum patch-pattern length of the patch patterns that can be formed within the allocation time based on a number of patch patterns that can be formed within the allocation time; and first setting including calculating a difference between a first environmental temperature around the image forming apparatus and a second environmental temperature at which the image forming condition stored in the storing unit is set, comparing the difference with a predetermined threshold, and setting newly an image forming condition for the patch patterns based on a result of comparing the difference and the threshold, wherein when the difference is smaller than the threshold, the first setting includes setting a region near a last updated image forming condition that is stored in the storing unit as an image forming condition for the patch patterns to be formed in the maximum patch-pattern length, and when the difference is larger than the threshold, the first setting includes setting an entire region of the image forming condition that can be set by the image forming apparatus as an image forming condition for the patch patterns to be formed in the maximum patch-pattern length.

10. The computer program product according to claim 9, wherein the image forming apparatus further includes a sheet accommodating unit that accommodates a sheet, a transfer unit that transfers an image formed on the image carrier onto the sheet based on image data to be printed, and a feeding unit that feeds the sheet from the sheet accommodating unit to the transfer unit, and the program codes further causes the computer to execute:

transferring an image formed on the image carrier onto the sheet based on image data to be printed; and feeding the sheet from the sheet accommodating unit to the transfer unit, wherein the first calculating includes setting a sheet feeding time during which the feeding unit conveys the sheet from the sheet accommodating unit to a transfer portion of the transfer unit as the allocation time.

11. The computer program product according to claim 10, wherein the image forming apparatus further includes a fixing unit that fixes the image transferred onto the sheet, and the first calculating includes calculating the allocation time required for forming the patch patterns based on a warm-up time of the fixing unit.

12. The computer program product according to claim 11, wherein the first calculating includes setting either one of the warm-up time and the sheet feeding time which is longer as the allocation time.

13. The computer program product according to claim 9, wherein the program codes further causes the computer to execute third calculating including calculating a minimum operation time taken for forming a minimum necessary number of patch patterns for performing a density adjustment, and the third calculating further includes comparing the minimum operation time with the allocation time, and when the minimum operation time is longer than the allocation time, stopping the density adjustment.

14. The computer program product according to claim 9, wherein the program codes further causes the computer to execute:

third calculating including calculating a minimum operation time taken for forming a minimum necessary number of patch patterns for performing a density adjustment; and second setting including receiving an acceptance of a downtime caused by the density adjustment from a user, and setting the downtime, and the second setting includes comparing the minimum operation time with the allocation time, and when the minimum operation time is longer than the allocation time and when the user acceptance is set, extending the allocation time up to the minimum operation time.

15. The computer program product according to claim 9, wherein the second calculating includes determining number of patches for each color as $(T1 \times V1)/\{(D1+D2) \times \text{number of colors}\}$, where D1 is reference patch-pattern length, D2 is patch-pattern interval, T1 is patch-pattern-forming allocation time, and V1 is image conveying speed of the image carrier.

16. The computer program product according to claim 9, wherein the second calculating includes calculating the maximum patch-pattern length as $\{(T1 \times V1) - D2 \times N1 \times \text{number of colors}\}/N1$, where D2 is patch-pattern interval, T1 is patch-pattern-forming allocation time, V1 is image conveying speed of the image carrier, and N1 is the number of patch patterns.

17. A method of forming an image in an image forming apparatus that forms a plurality of patch patterns on an image carrier, measures densities of the patch patterns formed on the image carrier, and updates an image forming condition for the patch patterns stored in a storing unit based on a result of measuring the density of the patch patterns, the method comprising:

first calculating including calculating an allocation time required for forming the patch patterns;

second calculating including calculating a maximum patch-pattern length of the patch patterns that can be formed within the allocation time based on a number of patch patterns that can be formed within the allocation time; and setting including calculating a difference between a first environmental temperature around the image forming apparatus and a second environmental temperature at which the image forming condition stored in the storing unit is set, comparing the difference with a predetermined threshold, and setting newly an image forming condition for the patch patterns based on a result of comparing the difference and the threshold, wherein when the difference is smaller than the threshold, the setting includes setting a region near a last updated image forming condition that is stored in the storing unit as an image forming condition for the patch patterns to be formed in the maximum patch-pattern length, and when the difference is larger than the threshold, the setting includes setting an entire region of the image forming condition that can be set by the image forming apparatus as an image forming condition for the patch patterns to be formed in the maximum patch-pattern length.

* * * * *